United States Patent [19]

Lai-Chun

[11] 4,359,491

[45] Nov. 16, 1982

[54] PROCESS FOR THE PREPARATION OF A THERMAL TRANSFERABLE TWINKLING PATTERN

[75] Inventor: Liu Lai-Chun, Taipei, Taiwan

[73] Assignee: Jin An Industrial Co., Ltd., Taipei, Taiwan

[21] Appl. No.: 221,833

[22] Filed: Dec. 31, 1980

[51] Int. Cl.[3] ..... B05D 1/36; B05D 5/06

[52] U.S. Cl. ..... 427/148; 427/197; 427/199; 427/265; 428/201; 428/206; 428/208; 428/210; 428/913; 428/914; 156/234; 156/240

[58] Field of Search ..... 427/148, 197, 195, 203, 427/265, 208.2, 199, 204; 428/200, 201, 206, 208, 210, 212, 914, 913; 156/234, 240

[56] References Cited

U.S. PATENT DOCUMENTS

| | | | |
|---|---|---|---|
| 1,331,581 | 2/1920 | Rosenfeld | 427/148 X |
| 1,882,593 | 10/1932 | Hentschel | 428/200 |
| 2,008,763 | 7/1935 | Lawrence et al. | 427/148 X |
| 3,172,942 | 3/1965 | Berg | 427/204 |
| 4,171,398 | 10/1979 | Hunt | 156/234 |

*Primary Examiner*—Shrive P. Beck

[57] ABSTRACT

A process for the preparation of a thermal transferable twinkling pattern is disclosed. The resulting colorful twinkling pattern preformed on a substrate may be transferred on any material to be decorated by simply applying heat and pressure, and a vivid twinkling colorful decorative effect will be achieved by incident light.

12 Claims, 6 Drawing Figures

PROCESS FOR THE PREPARATION OF A THERMAL TRANSFERABLE TWINKLING PATTERN

The present invention relates to a process for the preparation of a thermal transferable twinkling pattern.

In the prior art, it is well known to use aluminum flakes for producing a reflective decorative effect. This is accomplished by directly coating an adhesive resin on the material to be decorated according the predetermined pattern, then having the aluminum flakes distributed and fixed thereon. This conventional method has many disadvantages, such as a lot of unfixed aluminum flakes will be wasted during treatment, the contour of the pattern so treated does not give a sharp appearance and the ambiguous margins also cannot be trimmed, resulting in a quality too bad to be practically used.

For eliminating the mentioned drawbacks, an alternative method has been suggested, in which the reflective flakes of metal, such as aluminum or copper are directly admixed with resin, the admixture so obtained, after coated on a substrate, may be subjected to transprinting treatment. Since the resin will flow out of the surface of said admixture layer to cover parts of reflective material, the products exhibit a dull appearance and ready adherence between each other, the latter case will be more serious in case of the products superimposed together. Moreover, the finished pattern will be readily peeled off due to inferior adhesion, when ironing is applied.

The primary object of the present invention is to overcome the disadvantages of the conventional technique and to provide a process for the preparation of novel thermal transferable twinkling colorful pattern. The products are not sticky, but may easily be transferred on any material to be decorated by simply applying heat and pressure, and a vivid twinkling colorful decorative effect will be achieved by incident light. The products also exhibit brilliant colors, sharp contour lines, non-fading, non-peeling off, and good fastness to washing and rubbing and other advantages.

The metnioned object is accomplished by a process according to the present invention which comprises the steps of screen-printing a transient adhesive layer on the substrate according to any desired pattern; attaching a reflective metal flakes or finely divided glass particles layer on said transient adhesive layer by means of a conventional techniques selected from electrostatic deposition, dispersion, spray coating and the like; treating a hot-melt adhesive layer thereon; then dispersing a thermal sensitive adhesive layer on uppermost. The thermal sensitive adhesive may be in the form of powder or liquid resin, in latter case, a further step of drying is taken.

Embodiment of the process will now be described with reference to the accompanying drawings, which are all in elevational cross-section view schematically depicting the steps of the present invention, wherein.

Figure 1:
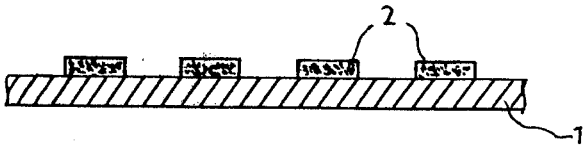
FIG. 1 illustrates the first step, according to the present invention to print a transient adhesive layer on the substrate.

In FIG. 1, the carrier substrate designated by 1 is prepared first of all, which may be a cardboard and preferably a high quality paper board having a weight around 150 grams per square meter. On the substrate, a transient adhesive layer 2 is applied in a desired pattern by means of a conventional screen printing method. This transient adhesive is selected to have a great adhesion to the substrate 1 but only a separable slight adhesion to the reflective material to be treated later thereon. This transient adhesive layer which may be used in the present invention comprises various polymer resins including polyvinyl alcohol, polyvinyl chloride, polyurethane, polyvinyl acetate, vinyl resins, or the combinations thereof, as well as one or more mixed solutions or emulsions of rubbers, starches, rosins, dextrins and the like. The amount of the transient adhesive applied is varied as required, but preferrably is about 200 grams per square meter. The pattern printed with the transient adhesive layer may be configured to includes any design, character, ornament, mark, sign, figure, interior decoration and the like.

Figure 2:
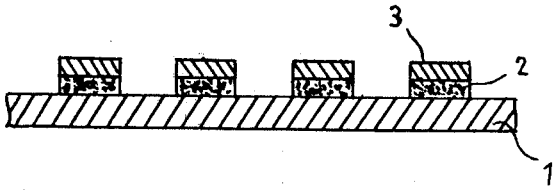
FIG. 2 illustrates the second step according to the present invention to attach a reflective material layer on said transient adhesive layer.

Next, referring to FIG. 2, the transient adhesive layer 2 printed as a pattern is treated with a reflective material layer 3. This reflective material 3 is selected from a group consisting of the flakes of metal, such as aluminum, copper and the like, and finely divided glass particles, either in original color or through treatment to exhibit any color, and may be used in monochromatic or multi-color. The metal flakes are preferably sized in the range between 0.01 and 0.06 mm in the form of square, rectangular or diamond shaped foil. The glass particles are preferably sized in the range between 0.01 and 0.10 mm in the form of circular, polygonal or irregular shape, but are most preferably in diamond shape since the angles thereof generate most colorful reflective effects. This reflective material is applied to the transient adhesive layer 2 by conventional means including electrostatic deposition, spraying or dispersing treatment, for distributing over all of the transient adhesive layer 2.

Figure 3:
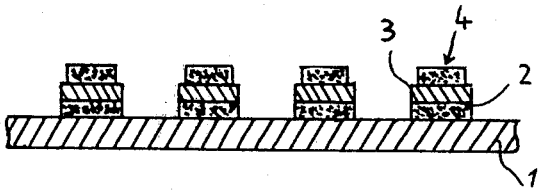
FIG. 3 illustrates the third step according to the present invention to apply a hot-melt adhesive layer on said reflective material layer.

Then, as shown in FIG. 3, on said reflective material layer 3 is further printed a layer of hot-melt adhesive 4 by conventional screen printing method. The hot-melt adhesive 4 should have a property of thermal adhesion to the material to be decorated, as referred hereinafter, when in use, and preferably selected from a group consisting of thermoplastic acrylic resins, polyethylene, polyvinyl chloride, rubbers or the mixtures thereof. On the treatment of this hot-melt adhesive 4, it is preferred to leave the margins of the reflective material layer 3 uncoated by adhesive 4.

Finally, as shown in FIG. 3, on the hot-melt adhesive layer 4 is coated with a layer of thermo sensitive adhesive 5, which may be either a powder, such as vinyl acetate compound powder, or a liquid, such as vinyl acetate resin solution. The powder may be applied by dispersion while the liquid is applied by screen printing methods, in latter case, the product will be finished after a further drying step. After treatment of the thermo sensitive adhesive, the finished product at normal conditions is not sticky and is convenient for storage or handling.

Figure 4:
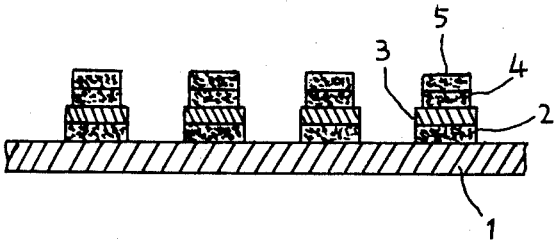
FIG. 4 illustrates the fourth step according to the present invention to treat a thermal sensitive adhesive layer on said hot-melt adhesive layer.
Figure 5:
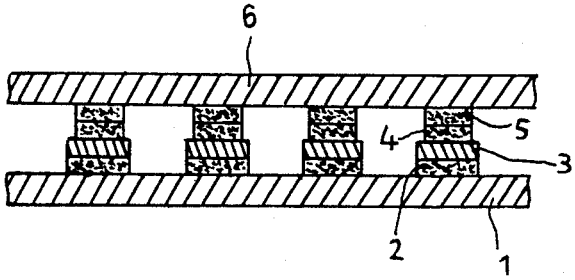
FIG. 5 illustrates the twinkling pattern product made by the present invention being closely adhered on the material to be decorated.

This inventive product is also very convenient in use. As shown in FIG. 5, closely position the assembly of FIG. 4 with the thermo sensitive material 5 side onto the material 6 to be decorated, such as various fabrics, woven products, papers, plastic sheets, chemical resin made boards, metal plates, wooden boards, flat concrete walls and the like. Then, apply heat on the back side of the substrate 1 at a temperature of 90° to 100° C. and a pressure from 50 g/cm$^2$ to 20 kg/cm$^2$ for a period between 10 to 15 seconds, to melt the hot-melt adhesive layer 4 and thermo sensitive material layer 5 and thus adhere some on the material 6. If the material 6 is selected from a group consisting of fabrics, woven products, papers and plastic sheets, the heat and pressure may be alternatively applied on the outside of said material 6 to be decorated.

Figure 6:
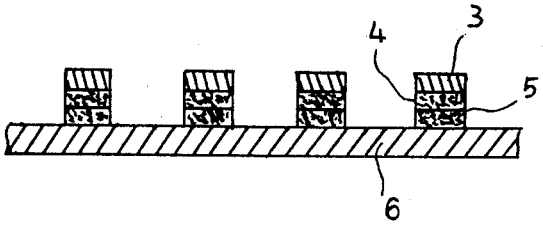
FIG. 6 illustrates the stage wherein the substate has been separated and the twinkling pattern is transferred to the material to be decorated.

Subsequently, separate the substrate 1 together with the transient adhesive layer 2, leaving the assembly as shown in FIG. 6, the hot-melt adhesive layer 5 and thermal sensitive adhesive layer 4 will transfer the reflective material 3 firmly adhered on the material 6. Upon transfer, the reflective material 3 on the margins portion that were untreated with hot-melt adhesive 4 will remain on the transient adhesive layer 2 and separated along with the substrate 1 as well. Consequently the reflective material layer 3, transplanted on the material 6, has sharp contours and neat appearance just as if directly printed thereon.

The invention is further illustrated by the following example.

EXAMPLE

The surface of a fine quality paper board substrate weighing 150 g/m$^2$ is printed with approximately 200 g/m$^2$ of a polyvinyl acetate adhesive emulsion having 30 weight% solid content by means of a conventional screen printing method according to a well designed pattern to form a transient adhesive layer. Then, on said transient adhesive layer is dispersed an admixture of aluminum foil flakes in thickness of 0.012 mm with size of 0.10×0.14 mm and flakes of resin film pretreated by deposition of aluminum molecules, to attach on said transient adhesive layer as a reflective material layer. Thereafter, a layer of acrylic mixed resin hot melt adhesive is printed on said reflective material by means of screen printing method, and a layer of thermo-sensitive vinyl acetate mixed powder adhesive is further distributed thereon. Thus the thermal transferable twinkling pattern product is obtained.

In use, attach said product at the pattern side on a fabric and apply on back side of said product (a) heat by an iron at a temperature about 90°–100° C., also apply a slight pressure by hand for a period of from 10 to 15 seconds, then separate the substrate, the pattern is completely transferred on said fabric.

What we claim is:

1. A process for the preparation of a thermal transferable twinkling pattern which comprises the steps of printing a transient adhesive layer on a substrate according to any desired pattern, attaching a reflective particulate material on said transient adhesive layer formed as a pattern, positioning a hot-melt adhesive layer thereon leaving the margins of said reflective material layer uncoated with said hot-melt adhesive and subsequently coating a thermosensitive adhesive layer on said hot-melt layer whereby upon transfer said reflective material at the uncoated margins will remain on said transient adhesive layer and will peel therewith along with said substrate providing the transferred reflective layer pattern with a sharp margin.

2. The process as claimed in claim 1, wherein the substrate is a paper board, weighing around 150 g/m$^2$.

3. The process as claimed in claim 1, wherein the transient adhesive layer is selected from a group consisting of polyvinyl alcohol, polyurethane, polyvinyl acetate, dextrins and mixture thereof.

4. The process as claimed in claim 1, wherein the reflective particulate material is flakes of a reflective material selected from the group consisting of reflective metals and flakes of resin film previously deposited with a reflective metal layer.

5. The process as claimed in claim 1, wherein the reflective material is finely divided glass particles.

6. The process as claimed in claim 1, wherein the hot-melt adhesive is selected from a group consisting of thermoplastic acrylic resins, polyvinyl chloride, and mixtures thereof.

7. The process as claimed in claim 1, wherein the thermo sensitive material comprises a vinyl acetate powder.

8. The process as claimed in claim 1, wherein the reflective material is glass particles used in original color.

9. The process as claimed in claim 8, wherein the reflective material is colored.

10. The process as claimed in claim 1, wherein a monochromatic reflective material is used.

11. The process as claimed in claim 1, wherein a multicolor reflective material is used.

12. A method of transferring a thermal transferrable twinkling pattern product produced in accordance with claim 1 to a material surface which comprises the steps of juxtaposing said product with its thermosensitive adhesive layer onto the surface of said material by applying heat at a temperature ranging from 90° to 100° C. and a pressure from 50 g/cm$^2$ to 20 kg/cm$^2$ for a period of 10 to 15 seconds and then peeling the unadhered portions of said product beyond the desired pattern from said material.

* * * * *